US005430349A

United States Patent [19]

New et al.

[11] Patent Number: 5,430,349

[45] Date of Patent: Jul. 4, 1995

[54] COLOR PICTURE TUBE HAVING AN INLINE ELECTRON GUN WITH THREE ASTIGMATIC LENSES

[75] Inventors: David A. New, Mercerville; Walter B. Paul, North Brunswick, both of N.J.; Olivier P. Trinchero; Jean-Pierre Garnier, both of Dijon, France

[73] Assignee: Thomson Tubes and Displays, S.A., Paris La Defense, France

[21] Appl. No.: 125,885

[22] Filed: Sep. 24, 1993

[51] Int. Cl.[6] ..... H01J 29/46

[52] U.S. Cl. ..... 313/412; 313/414

[58] Field of Search ..... 313/412, 413, 414; 315/382, 15

[56] References Cited

U.S. PATENT DOCUMENTS

| | | | |
|---|---|---|---|
| 3,497,763 | 2/1970 | Hasker | 315/31 |
| 3,866,081 | 2/1975 | Hasker et al. | 313/449 |
| 4,234,814 | 11/1980 | Chen et al. | 313/412 |
| 4,242,613 | 12/1980 | Brambring et al. | 313/447 |
| 4,251,747 | 2/1981 | Burdick | 313/348 |
| 4,272,700 | 6/1981 | Collins | 313/458 |
| 4,558,253 | 12/1985 | Bechis et al. | 313/414 |
| 4,877,998 | 10/1989 | Maninger et al. | 315/15 |
| 5,061,881 | 10/1991 | Suzuki et al. | 315/382 |
| 5,241,237 | 8/1993 | Misono et al. | 315/382 |

FOREIGN PATENT DOCUMENTS

| | | | |
|---|---|---|---|
| 0452789 | 10/1991 | European Pat. Off. | 313/414 |

*Primary Examiner*—Donald J. Yusko
*Assistant Examiner*—N. D. Patel
*Attorney, Agent, or Firm*—Joseph S. Tripoli; Dennis H. Irlbeck

[57] ABSTRACT

An improved color picture tube includes a screen and an inline gun for generating and directing three inline electron beams along separate paths toward the screen. The electron gun includes electrodes that provide a beam-forming region, a prefocus region and a main focus region. The beam-forming region of the gun includes a cathode, a G1 electrode, a G2 electrode and a first portion of a G3 electrode. The prefocus region includes a second portion of the G3 electrode, a G4 electrode and a first portion of a G5 electrode. The main focus region includes a second portion of the G5 electrode and a G6 electrode. The improvement resides in the beam-forming region, the prefocus region and the main focus region each being astigmatic.

7 Claims, 5 Drawing Sheets

COLOR PICTURE TUBE HAVING AN INLINE ELECTRON GUN WITH THREE ASTIGMATIC LENSES

This invention relates to color picture tubes having inline electron guns, and particularly to an improvement in such guns to provide a reduction in the sensitivity of electron beam flare changes to changes in electron beam current.

BACKGROUND OF THE INVENTION

Electron guns used in color picture tubes, such as for use in television, are required to achieve good electron beam spot behavior over the entire screen. This requirement is complicated by the presence of astigmatic yoke fields that are necessary to maintain convergence of three beams over the entire screen. In tubes which feature dynamic astigmatism control, the yoke-induced astigmatism is corrected through modulation of the voltage applied to the electrodes in the electron gun or by magnetic components located on the exterior of the tube neck.

In tubes that do not feature dynamic astigmatism control, a reasonable compromise between performance at the screen center and at locations near the periphery of the screen must be achieved. This compromise is usually made in one of two ways. First, astigmatism can be added to the beam in the electron gun so that the spot at the screen center is vertically underfocused when it is at its best horizontal focus. At the periphery of the screen, this astigmatism then cancels some of the vertical overfocusing caused by the yoke. The second technique is to reduce the vertical beam size in the main focus lens. This second technique tends to reduce the variation of vertical spot size at the screen caused by focus voltage changes, and also reduces the magnitude of the yoke-induced astigmatism. As a result, vertical spots overfocused by the yoke are not degraded to the same extent as those with larger vertical beam sizes in the main focus lens. Both of these techniques, however, improve vertical spot uniformity of the deflected beams at the expense of degrading vertical spot size at the screen center.

Beam astigmatism is typically introduced into the gun through design of the main focus region electrodes. The vertical beam size, entering the main focus region, is generally controlled independently from the horizontal beam size, through the introduction of slots or other shaped apertures or recesses into the beam-forming region or prefocus region of the electron gun. Astigmatism and vertical beam size, and hence vertical spot uniformity, can be adjusted at some particular beam current, through appropriate design of the main focus lens in combination with a beam-forming region slot.

The concept of forming an astigmatic lens in the beam-forming region of an electron gun by the inclusion of a slot in the first electrode grid is disclosed in the following U.S. Patents: U.S. Pat. No. 4,242,613, issued to J. Brambring et al. on Dec. 30, 1980; U.S. Pat. No. 4,25 1,747, issued to G. A. Burdick on Feb. 17, 1981; U.S. Pat. No. 4,272,700, issued to F. K. Collins on Jun. 9, 1981; and U.S. Pat. No. 4,558,243, issued to Bechis et al. on Dec. 10, 1985. Slots in the second electrode grid are disclosed in the following U.S. Patents: U.S. Pat. No. 3,497,763 issued to J. Hasker Feb. 24, 1970; U.S. Pat. No. 3,866,081 issued to J. Hasker et al. on Feb. 11, 1975; and U.S. Pat. No. 4,234,814 issued to H. Y. Chen at al. on Nov. 18, 1980.

The beam ellipticity that can be achieved by slot optics in the beam-forming region is limited by fabrication and assembly constraints. In some guns, slot shaped recesses are placed around each of the three apertures in the G1 electrode. The stamping process used limits the depth and width of the slots to dimensions that produce relatively small degrees of ellipticity (about 1.5:1). Alternative approaches, such as an open crossed slot G1 grid, can achieve the desired ellipticity (>1.7:1), but at the expense of more complicated fabrication and assembly processes. The use of strong slots in the beam-forming region can also result in highly non-uniform beams at high currents, leading to large spots at the screen. Slots in the beam-forming region can reduce vertical beam growth with increasing beam current, when compared to beam-forming regions with round-optics. This reduced vertical beam growth can have a beneficial effect on spot uniformity.

An additional important consideration in electron gun design is how vertical spot uniformity evolves with beam current. Because vertical flare is particularly objectionable at high currents, an increase in astigmatism with beam current to minimize the overfocus flare of high-current deflected spots can be beneficial. Additionally, there is a need to minimize the increase in vertical beam size with increasing current.

Slots located in the prefocus lens region of the gun can produce, for some intermediate beam currents (less than 2000 $\mu$A), the desired degree of beam ellipticity required to achieve a horizontal beam size sufficiently large for a given level of horizontal resolution, and at the same time, a vertical beam size sufficiently small to obtain the desired degree of vertical spot uniformity.

The use of slots in the prefocus lens region of a gun is shown in U.S. Pat. No. 4,877,998, issued to Maninger et al. on Oct. 31, 1989. In that patent, the slots are shaped apertures in the G4 electrode. The apertures in the G4 are elongated in the inline direction of the beams, whereby each aperture includes a substantially circular center portion and two oppositely disposed arcuate portions that intersect the circumference of the circular center portion.

The above-mentioned patents provide various contributions to the cathode-ray tube art, but they do not suggest how the concepts disclosed therein can be combined to obtain an electron gun having decidedly improved performance at higher beam currents (e.g., above 2000 $\mu$A), without using dynamic astigmatism control.

SUMMARY OF THE INVENTION

An improved color picture tube includes a screen and an inline gun for generating and directing three inline electron beams along separate paths toward the screen. The electron gun includes electrodes that provide a beam-forming region, a prefocus region and a main focus region. The beam-forming region of the gun includes a cathode, a G1 electrode, a G2 electrode and a first portion of a G3 electrode. The prefocus region includes a second portion of the G3 electrode, a G4 electrode and a first portion of a G5 electrode. The main focus region includes a second portion of the G5 electrode and a G6 electrode. The improvement comprises the beam-forming region, the prefocus region and the main focus region each being astigmatic.

DETAILED DESCRIPTION OF THE PREFERRED EMBODIMENTS

Figure 1:
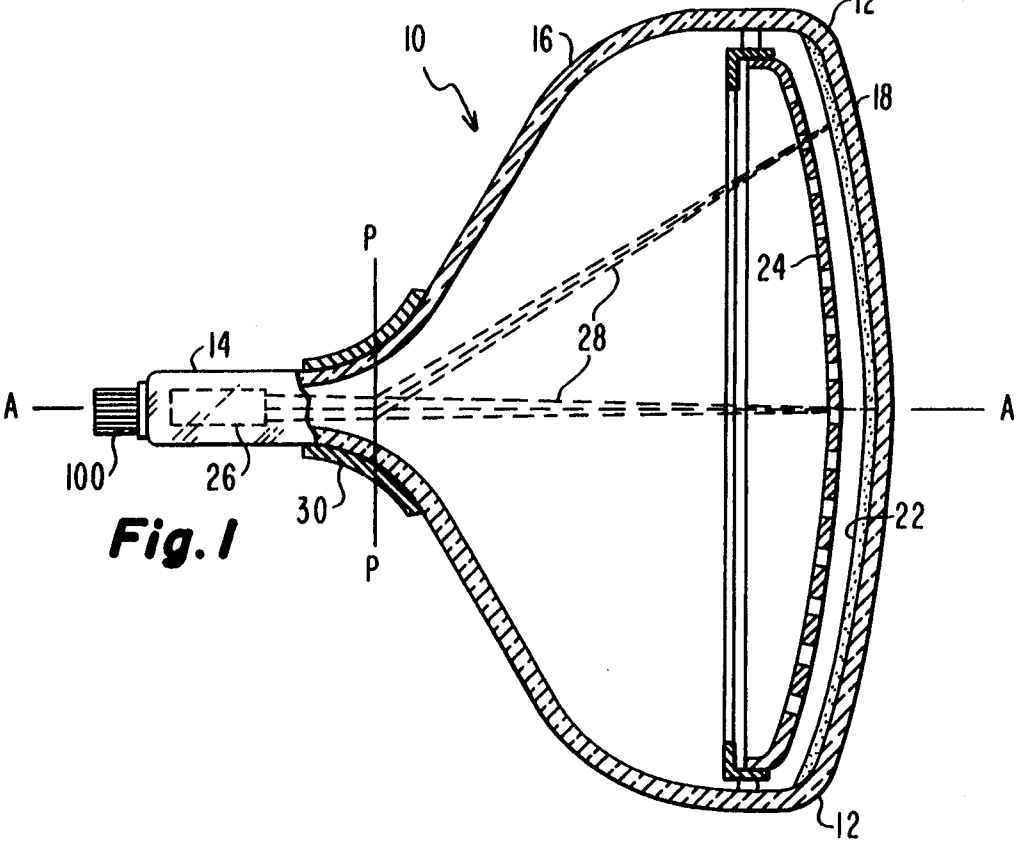
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20, which is sealed to the funnel 16. A three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color-selection electrode or shadow mask 24 is removably mounted in predetermined spaced relation to the screen 22. An improved inline electron gun 26, shown schematically by dotted lines in FIG. 1, is centrally mounted within the neck 14, to generate and direct three electron beams 28 along coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1.

The details of the electron gun 26 are shown in FIGS. 2 through 5. The electron gun comprises two glass supports rods 32 on which various electrodes are mounted. These electrodes include three equally spaced coplanar cathodes 34 (one for each beam), a G1 grid electrode 36, a G2 grid electrode 38, a G3 electrode 40, a G4 electrode 42, a G5 electrode 44 and a G6 electrode 46, spaced along the glass rods 32 in the order named. Each of the post-cathode electrodes has three inline apertures therein to permit passage of three coplanar electron beams.

Figure 3:
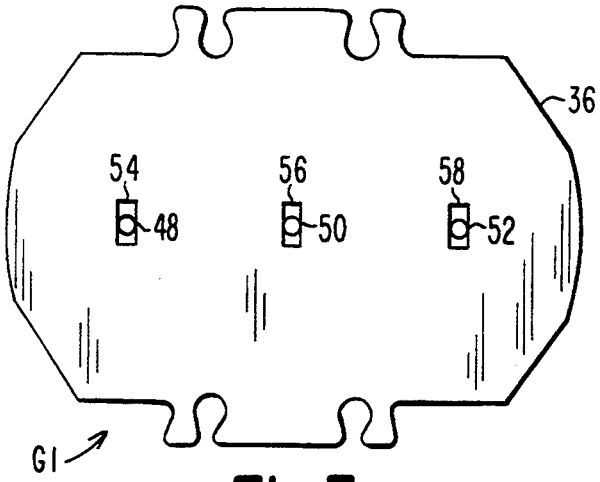
FIG. 3 is a plan view of the side of the G1 electrode that faces the G2 electrode, taken at line 3—3 of FIG. 2.

The G1 grid electrode 36 and the G2 grid electrode 38 are parallel flat plates that can include embossings therein for added strength. As shown in FIG. 3, the G1 grid electrode 36 includes, in addition to three inline apertures 48, 50 and 52, three vertically elongated slots 54, 56 and 58, respectively superposed on the apertures, on the side of the G1 grid electrode 36 facing the G2 grid electrode 38. The elongated dimension of the slots 54, 56 and 58 extends in a direction perpendicular to the inline direction of the apertures. The G3 electrode 40 is formed with a cup-shaped element 60, the bottom of which faces the G2 grid electrode 38, and a plate-shaped element 62 covering the open end of the cup-shaped element 60.

Figure 4:
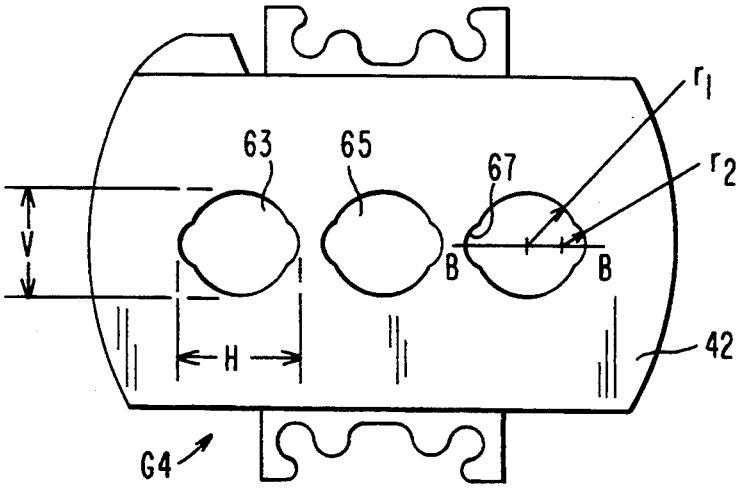
FIG. 4 is a plan view of the G4 electrode, taken at line 4—4 of FIG. 2.

The G4 electrode 42 comprises a substantially flat plate having three inline apertures 63, 65 and 67 therein, as shown in FIG. 4. The inline apertures are elongated in the horizontal direction, i.e., in the direction of the inline apertures. Each aperture includes a substantially circular center portion and a pair of oppositely disposed arcuate portions located on each side of the circular center portion. This G4 structure is described in greater detail in U.S. Pat. No. 4,877,998, cited above.

The G5 electrode 44 is formed with three cup-shaped elements 68, 70 and 72. The closed end of one of the elements 70 is nested in the open end of another element 68, with the closed end of the element 68 facing the G4 electrode 42 The open ends of the elements 70 and 72 are connected. Although the G5 electrode 44 is shown as a three-piece structure, it could be fabricated from any number of elements. The G6 electrode 46 also is cup-shaped, its open end being closed with the apertured closed end of a shield cup 74.

Figure 5:
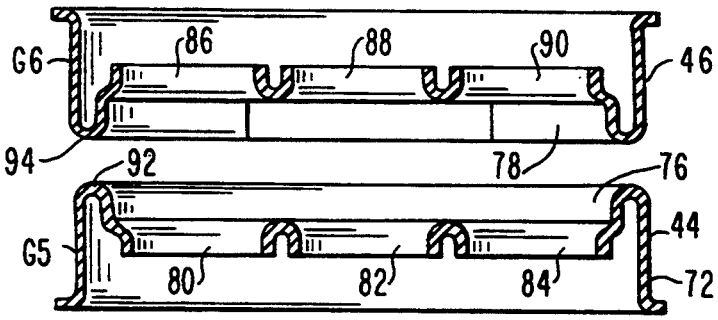
FIG. 5 is a cross-sectional view of the G5 and G6 electrodes, taken at line 5—5 of FIG. 2.

The facing closed ends of the G5 electrode 44 and the G6 electrode 46 have large recesses 76 and 78, respectively, therein, as shown in FIG. 5. The recesses 76 and 78 set back the portion of the closed end of the G5 electrode 44 that contains three apertures 80, 82 and 84 from the portion of the closed end of the G6 electrode 46 that contains three apertures 86, 88, and 90. The remaining portions of the closed ends of the G5 electrode 44 and the G6 electrode 46 form noncircular rims 92 and 94, respectively, that extend peripherally around the recesses 76 and 78. The rims 92 and 94 are the closest portions of the two electrodes 44 and 46 to each other. The configuration of the recess 78 in the G6 electrode 46 is slightly different than that of the recess 76 in the G5 electrode 44.

Figure 2:
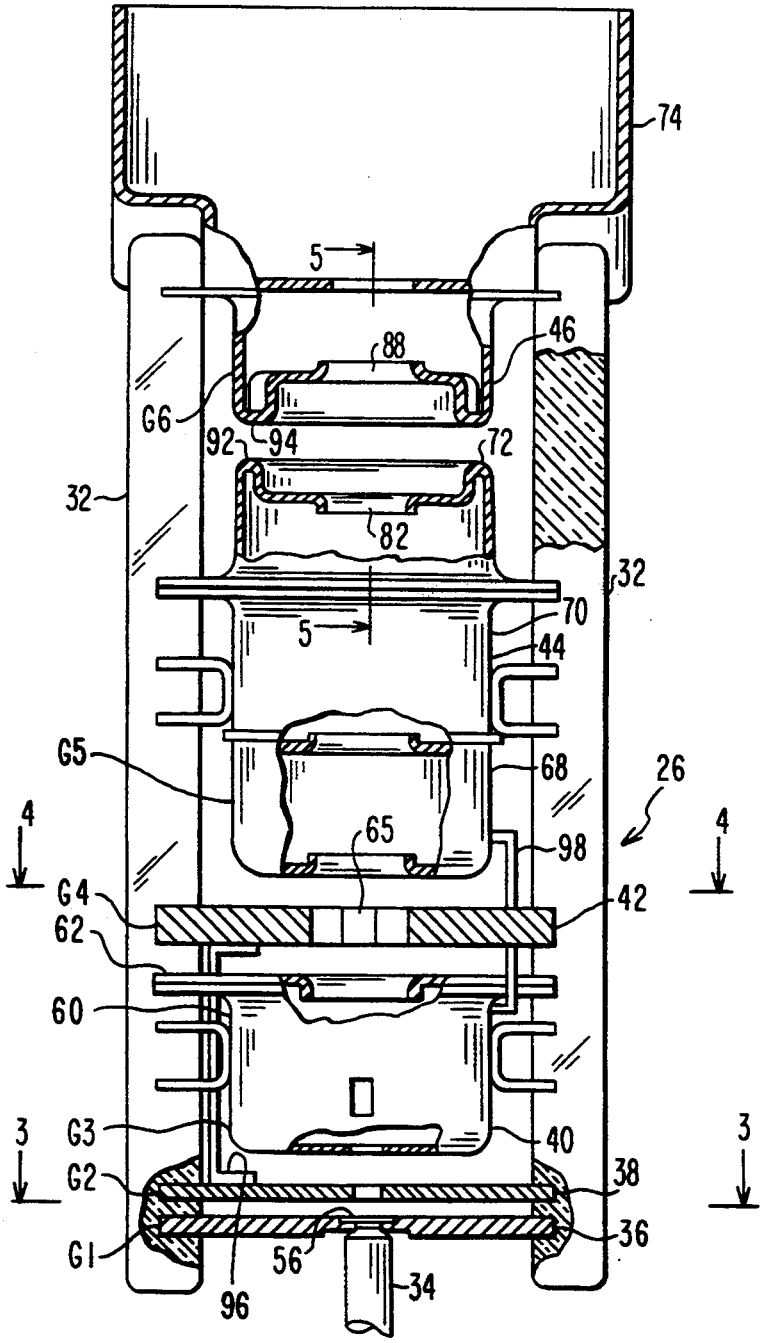
FIG. 2 is a partial axial section side view of the electron gun shown in dashed lines in FIG. 1.

The G4 electrode 42 is electrically connected by a lead 96 to the G2 electrode 38, and the G3 electrode 40 is electrically connected by a lead 98 to the G5 electrode 44, as shown in FIG. 2. Separate leads (not shown) connect the G1 grid electrode 36, the cathodes 34 and the cathode heaters to a base 100 (shown in FIG. 1) of the tube 10, so that these components can be electrically excited. Electrical excitation of the G6 electrode 46 is obtained by a contact between the shield cup 74 and an internal conductive coating of the tube which is connected to an anode button extending through the funnel 16.

In the electron gun 26, the cathodes 34, the G1 grid electrode 36, the G2 grid electrode 38 and a first portion of the G3 electrode 40 that faces the G2 grid electrode 38 comprise the beam-forming region of the gun. During tube operation, modulated control voltages are applied to the cathodes 34, the G1 grid electrode 36 is grounded, and a fixed relatively low positive voltage (e.g., between 800 and 1100 volts) is applied to the G2 grid electrode 38. The remaining portion of the G3 electrode 40, the G4 electrode 42, and the facing portion of the G5 electrode 44 comprise a prefocusing lens portion of the electron gun 26. During tube operation, a focus voltage is applied to both the G3 electrode 40 and the G5 electrode 44, and the fixed relatively low positive voltage is applied to the G4 electrode 42. The facing portions of the G5 electrode 44 and the G6 electrode 46 comprise the main focus lens of the electron gun 26. During tube operation, an anode voltage is applied to the G6 electrode 46, so that a bipotential focus lens is formed between the G5 and G6 electrodes.

Some typical dimensions for the electron gun 26 of FIG. 2 are presented in the following table.

TABLE

| | | |
|---|---|---|
| K–G1 spacing | 0.76 mm | (0.003 in.) |
| G1 and G2 aperture diameter | 0.64 mm | (0.025 in.) |
| G1 thickness at apertures | 0.14 mm | (0.0055 in.) |
| Depth of G1 slot | 0.15 mm | (0.006 in.) |
| G1 slot width | 0.74 mm | (0.029 in.) |
| G1 slot height | 1.52 mm | (0.060 in.) |
| G1–G2 spacing | 0.25 mm | (0.010 in.) |
| G2 thickness at apertures | 0.51 mm | (0.020 in.) |
| G2–G3 spacing | 1.02 mm | (0.040 in.) |
| G3 entrance aperture diameter | 1.52 mm | (0.060 in.) |
| G3 length | 5.08 mm | (0.200 in.) |
| G3 exit aperture diameter | 3.76 mm | (0.148 in.) |
| G3–G4 spacing | 1.27 mm | (0.050 in.) |
| G4 slot aperture width | 4.32 mm | (0.170 in.) |
| G4 slot aperture height | 4.01 mm | (0.158 in.) |
| G4 thickness | 0.64 mm | (0.025 in.) |
| G4–G5 spacing | 1.27 mm | (0.050 in.) |
| G5 entrance aperture diameter | 4.01 mm | (0.158 in.) |
| G5–G6 spacing | 1.27 mm | (0.050 in.) |
| Center-to-center spacing between adjacent apertures in G5 | 5.08 mm | (0.200 in.) |
| Diameter of apertures in G5 and G6 | 4.06 mm | (0.160 in.) |
| Depth of recess in G5 | 1.98 mm | (0.078 in.) |

Figure 6:
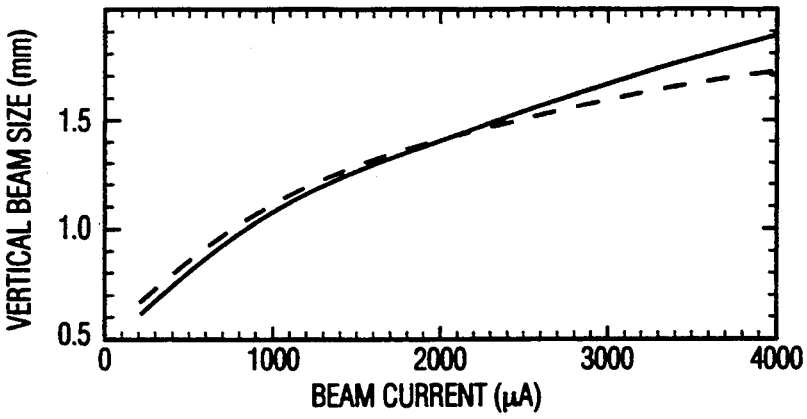
FIG. 6 is a graph of vertical beam size versus beam current, for both a prior electron gun and for the electron gun of FIG. 2.

In FIG. 6, the variation of vertical beam size as a function of beam current is plotted for two electron guns. Both guns were designed to have approximately the same horizontal and vertical beam sizes, cutoff voltages and astigmatisms. Both gun designs feature comparable increases in astigmatism with increases in beam current which are beneficial for high current line uniformity. One gun, shown by solid lines, uses a round-optics beam-forming region and a weak-slot prefocus lens. The other gun, shown by dashed lines, uses a slotted G1 and a weak-slot prefocus lens, such as the novel gun 26 of FIG. 2. FIG. 6 shows that, while the vertical beam sizes of the two guns are substantially identical up to 2000 μA, the novel gun, shown in dashed lines, demonstrates a significantly slower rate of increase in beam vertical size with further increases in beam current.

Figure 7:
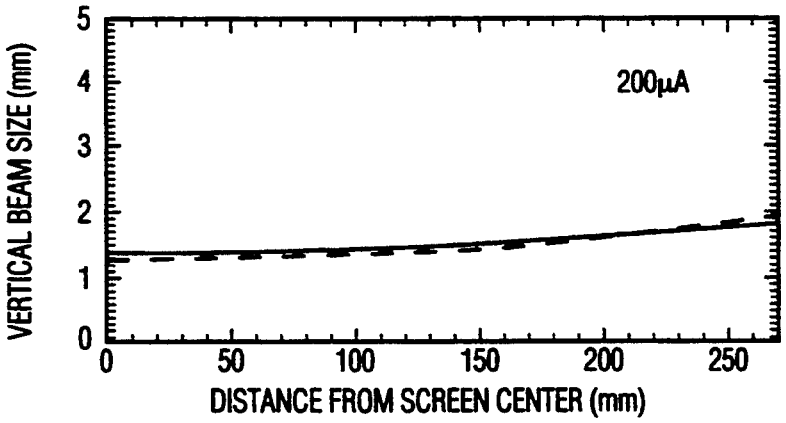
FIGS. 7, 8 and 9 are graphs of the variations in vertical beam size versus distance along the major axis of a tube, for a prior electron gun and the electron gun of FIG. 2, operated at beam currents of 200 μA, 1500 μA and 3000 μA, respectively.
Figure 8:
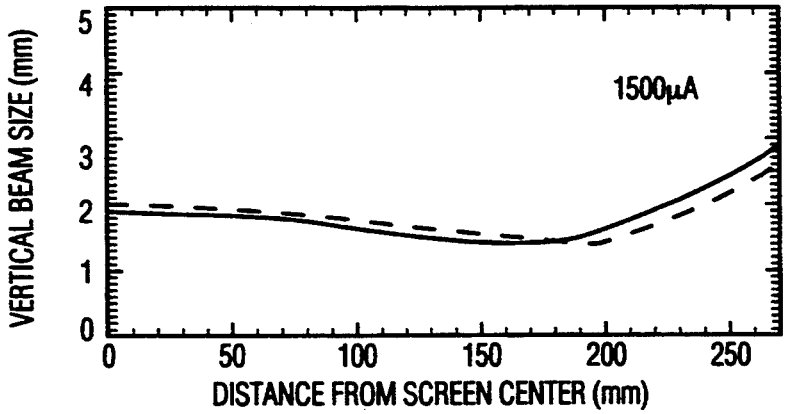
Figure 9:
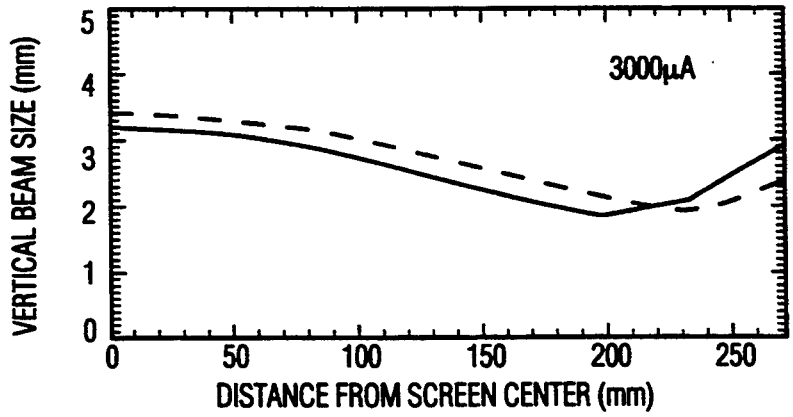

FIGS. 7, 8 and 9 show comparisons in vertical beam size along the major axes for three beam currents, $I_B$, 200 μA, 1500 μA and 3000 μA, respectively, for the same two guns. Again, the performance of the novel gun is shown by dashed lines. At the low current of 200 μA, both guns perform almost identically. At 1500 μA, a noticeable improvement is achieved by the novel gun, with a slightly larger spot at the center portion of the screen, but a significantly better spot at the sides of the screen. At 3000 μA, the improvement at the sides of the screen that was noted at 1500 μA is further enhanced.

Figure 10:
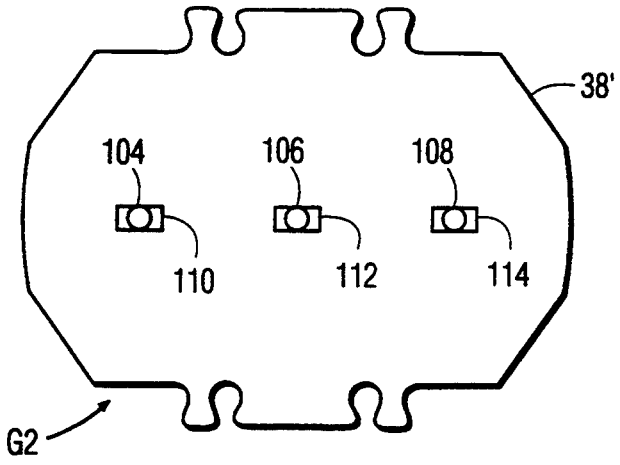
FIG. 10 is a plan view of the side of a G2 electrode that faces a G1 electrode of a second alternative electron gun in an embodiment of the invention.
Figure 11:
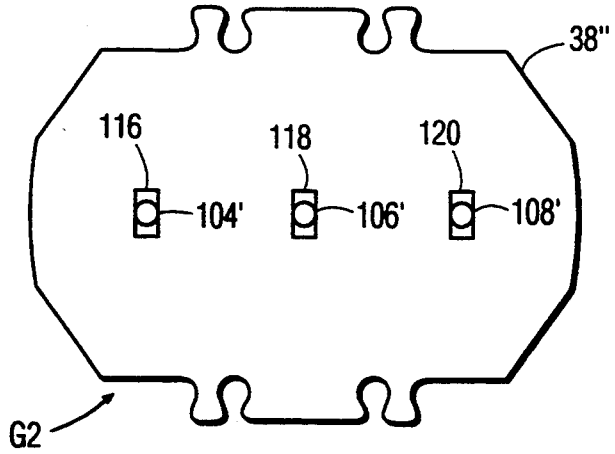
FIG. 11 is a plan view of the side of a G2 electrode that faces a G3 electrode of a third alternative electron gun in an embodiment of the invention.

Although the first preferred embodiment has been shown with an astigmatic beam-forming region in which the astigmatism is caused by a vertical slot in the side of the G1 electrode facing the G2 electrode, a similar effect can be achieved by a horizontal slot on the side of the G2 electrode that faces the G1 electrode. FIG. 10 shows such a G2 electrode 38' three inline apertures 104, 106 and 108, with three horizontal slots 110, 112 and 114, respectively, superposed on the apertures on the side of the G2 electrode 38' that faces the G1 electrode. Furthermore, a similar effect, although of different magnitude, can be achieved by placement of a horizontal slot on the side of the G2 facing the G3 electrode. FIG. 11 shows such a G2 electrode 38" having three inline apertures 104', 106' and 108', with three horizontal slots 116, 118 and 120, respectively, superposed on the apertures on the side of the G2 electrode 38" that faces the G3 electrode. In both of these embodiments, a G1 electrode which either has or does not have slots may be used in the electron gun. The scope of the present invention covers all of these alternative embodiments of the beam-forming region in an electron gun having an astigmatic beam-forming region, an astigmatic prefocus region and an astigmatic main lens.

Figure 12:
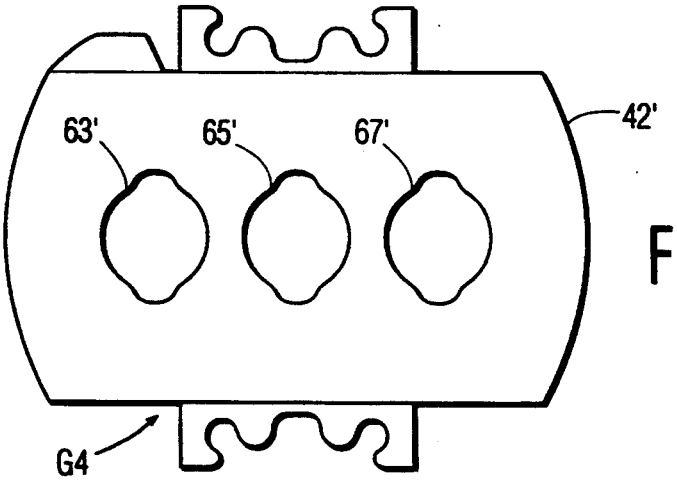
FIG. 12 is a plan view of a G4 electrode of a fourth alternative gun in an embodiment of the invention.

In the first preferred embodiment, the prefocus region includes horizontally elongated apertures in the G4 electrode. It is contemplated that, in some instances, it may be desirable to place vertically elongated apertures in the G4 electrode. FIG. 12 shows a G4 electrode 42' that includes three inline vertically elongated apertures 63', 65' and 67'. The slotted G4 electrode 42' forms an astigmatic prefocus region that can be used in combination any type of astigmatic beam-forming region or astigmatic main focus lens. The scope of the present invention also covers such alternative embodiments.

We claim:

1. In a color picture tube including a screen and an inline gun for generating and directing three inline electron beams along separate paths toward the screen, said gun including electrodes that provide a beam-forming region, a prefocus region and a main focus region, the electrodes of said beam-forming region including a G1 and a G2 electrode and a first portion of a G3 electrode, the electrodes of said prefocus region including a second portion of said G3 electrode, a G4 electrode and a first portion of a G5 electrode, and the electrodes of said main focus region including a second portion of said G5 electrode and a G6 electrode, the improvement comprising said beam-forming region being astigmatic with the astigmatism being formed by vertically elongated slots superposed on each of three circular apertures located in said G1 electrode on the side of said G1 electrode that faces said G2 electrode, said prefocus region being astigmatic with the astigmatism being formed by horizontally elongated apertures in said G4 electrode, and said main focus region being astigmatic with the astigmatism being formed by horizontally elongated rims on facing portions of said G5 and G6 electrodes.

2. In a color picture tube including a screen and an inline gun for generating and directing three inline electron beams along separate paths toward the screen, said gun including electrodes that provide a beam-forming region, a prefocus region and a main focus region, the electrodes of said beam-forming region including a G1 electrode and a G2 electrode and a first portion of a G3 electrode, the electrodes of said prefocus region including a second portion of said G3 electrode, a G4 electrode and a first portion of a G5 electrode, and the electrodes of said main focus region including a second portion of said G5 electrode and a G6 electrode, the improvement comprising said beam-forming region being astigmatic, said prefocus region being astigmatic with the astigmatism being formed by horizontally elongated apertures in said G4 electrode, and said main focus region being astigmatic with the astigmatism being formed by horizontally elongated rims on facing portions of said G5 and G6 electrodes.

3. The tube as defined in claim 2 wherein the beam-forming region astigmatism is formed by horizontally elongated slots superposed on each of three circular apertures located in said G2 electrode on the side of said G2 electrode that faces said G1 electrode.

4. The tube as defined in claim 2 wherein the beam-forming region astigmatism is formed by vertically elongated slots superposed on each of three circular apertures located in said G2 electrode on the side of said G2 electrode that faces said G3 electrode.

5. In a color picture tube including a screen and an inline gun for generating and directing three inline electron beams along separate paths toward the screen, said gun including electrodes that provide a beam-forming region, a prefocus region and a main focus region, the electrodes of said beam-forming region including a G1 electrode and a G2 electrode and a first portion of a G3 electrode, the electrodes of said prefocus region including a second portion of said G3 electrode, a G4 electrode and a first portion of a G5 electrode, and the electrodes of said main focus region including a second portion of said G5 electrode and a G6 electrode, the improvement comprising said beam-forming region being astigmatic, said prefocus region being astigmatic with the astigmatism being formed by vertically elongated apertures in said G4 electrode, and said main focus region being astigmatic with the astigmatism being formed by horizontally elongated rims on facing portions of said G5 and G6 electrodes.

6. The tube as defined in claim 5 wherein the beam-forming region astigmatism is formed by horizontally elongated slots superposed on each of three circular apertures located in said G2 electrode on the side of said G2 electrode that faces said G1 electrode.

7. The tube as defined in claim 5 wherein the beam-forming region astigmatism is formed by vertically elongated slots superposed on each of three circular apertures located in said G2 electrode on the side of said G2 electrode that faces said G3 electrode.

* * * * *